US005679116A

United States Patent [19]

Cunningham et al.

[11] Patent Number: 5,679,116

[45] Date of Patent: Oct. 21, 1997

[54] COMPOSITIONS FOR CONTROL OF INDUCTION SYSTEM DEPOSITS

[75] Inventors: Lawrence J. Cunningham, Kirkwood, Mo.; Don P. Hollrah, Midlothian, Va.; Alexander M. Kulinowski, St. Louis, Mo.

[73] Assignee: Ethyl Corporation, Richmond, Va.

[21] Appl. No.: 629,724

[22] Filed: Apr. 9, 1996

Related U.S. Application Data

[62] Division of Ser. No. 364,064, Dec. 27, 1994, which is a continuation of Ser. No. 956,120, Oct. 5, 1992, abandoned, which is a continuation-in-part of Ser. No. 878,969, May 6, 1992, abandoned.

[51] Int. Cl.[6] ..... C10L 1/30; C10L 1/22

[52] U.S. Cl. ..... 44/359; 44/432

[58] Field of Search ..... 44/359, 432

[56] References Cited

U.S. PATENT DOCUMENTS

| | | | |
|---|---|---|---|
| 3,960,515 | 6/1976 | Honnen | 44/432 |
| 4,039,300 | 8/1977 | Chloupek et al. | 44/432 |
| 4,155,718 | 5/1979 | Graiff | 44/359 |
| 4,877,416 | 10/1989 | Campbell | 44/432 |
| 5,006,130 | 4/1991 | Aiello et al. | 44/432 |
| 5,405,419 | 4/1995 | Ausari et al. | 44/432 |
| 5,496,383 | 3/1996 | Franz et al. | 44/432 |
| 5,503,644 | 4/1996 | Graiff et al. | 44/432 |
| 5,551,957 | 9/1996 | Cunningham et al. | 44/359 |

*Primary Examiner*—Jerry D. Johnson

*Attorney, Agent, or Firm*—Dennis H. Rainear; Thomas Hamilton

[57] ABSTRACT

Fuel additives and fuel additive compositions are described comprising: (i) at least one fuel-soluble detergent/dispersant which is (a) a fuel-soluble salt, amide, imide, oxazoline and/or ester, or a mixture thereof, of a long chain aliphatic hydrocarbon-substituted dicarboxylic acid or its anhydride, (b) a long chain aliphatic hydrocarbon having a polyamine attached directly thereto, and/or (c) a Mannich condensation product formed by condensing a long chain aliphatic hydrocarbon-substituted phenol with an aldehyde, and an amine; wherein the long chain hydrocarbon group in (a), (b) and (c) is a polymer of at least one $C_2$ to $C_{10}$ monoolefin, said polymer having a number average molecular weight of at least about 300; (ii) a fuel-soluble cyclopentadienyl complex of a transition metal; and (iii) a fuel-soluble liquid carrier or additive induction aid. These compositions in use enable surprising improvements in intake valve deposit control as well as other advantages.

17 Claims, No Drawings

COMPOSITIONS FOR CONTROL OF INDUCTION SYSTEM DEPOSITS

REFERENCE TO RELATED APPLICATION

This is a division of pending application Ser. No. 08/364,064, filed Dec. 27, 1994, which in turn is a continuation of the now abandoned application Ser. No. 07/956,120 filed on Oct. 5, 1992, which in turn was a continuation-in-part of the now abandoned application Ser. No. 07/878,969 filed on May 6, 1992.

TECHNICAL FIELD

This invention relates to controlling or reducing fuel induction system deposits in internal combustion engines. More particularly this invention relates to detergent/dispersant compositions and to distillate fuels and distillate fuel additive concentrates capable of controlling or reducing the amount of intake valve deposits formed during engine operation.

BACKGROUND

A problem frequently encountered in the operation of gasoline and diesel engines is the formation of undesirable amounts of engine deposits, such as induction system deposits, and especially intake valve or injector deposits.

Prior copending applications Ser. No. 648,555 of G. M. Wallace and J. P. Simmonds, Ser. Nos. 737,195 and 760,341 of L. J. Cunningham, and Ser. No. 793,544 of D. J. Malfer, which applications are all assigned to subsidiaries of. Ethyl Corporation, describe effective succinimide-based compositions for controlling and/or reducing the severity of problems associated with the formation of engine deposits.

Use of fuel-soluble long chain aliphatic polyamines as induction cleanliness additives in distillate fuels is described for example in U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; and 5,086,115; and published European Patent Application 384,086.

Use in gasoline of fuel-soluble Mannich base additives formed from a long chain alkyl phenol, formaldehyde (or a formaldehyde precursor thereof), and a polyamine to control induction system deposit formation in internal combustion engines is described for example in U.S. Pat. No. 4,231,759.

THE INVENTION

In accordance with this invention, the effectiveness of certain fuel-soluble induction system deposit control additives is improved by including in a distillate fuel containing one or more such additives, at least one fuel-soluble cyclopentadienyl complex of a transition metal. More particularly, use in distillate fuels of the combination of (i) at least one fuel-soluble detergent/dispersant induction system cleanliness additive described hereinafter, (ii) at least one fuel-soluble cyclopentadienyl complex a transition metal described hereinafter, and (iii) at least of fuel-soluble liquid carrier or additive inductibility aid described hereinafter can sharply reduce the formation or accumulation of engine deposits such as intake valve deposits in internal combustion engines. In fact, compositions of this invention can function synergistically whereby the effectiveness of a highly effective deposit control additive—i.e., component (i) above—can be improved by the addition thereto of the cyclopentadienyl transition metal complex or compound, the latter not known to be a substance that reduces deposits. Additionally, in at least some cases use of the compositions of this invention in gasoline engines can result in control or minimization of octane requirement increase. Moreover, at least some of the compositions of this invention reduce combustion chamber deposit formation such as deposits which tend to form on piston tops and on cylinder heads. Thus this invention can provide to the art advantages that could not have been foreseen on the basis of any presently-known prior art.

In general, the detergent/dispersants utilized pursuant to this invention are fuel-soluble detergent/dispersants selected from the group consisting of (a) fuel-soluble salts, amides, imides, oxazolines and esters, or mixtures thereof of long chain aliphatic hydrocarbon-substituted dicarboxylic acids or their anhydrides, (b) long chain aliphatic hydrocarbons having a polyamine attached directly thereto, and (c) Mannich condensation products formed by condensing a long chain aliphatic hydrocarbon-substituted phenol with an aldehyde, preferably formaldehyde, and an amine, preferably a polyamine; wherein the long chain hydrocarbon group in (a), (b) and (c) is a polymer of at least one $C_2$ to $C_{10}$ monoolefin, preferably at least one $C_2$ to $C_5$ monoolefin, and most preferably at least one $C_3$ to $C_4$ monoolefin, said polymer having a number average molecular weight of at least about 300, preferably at least about 400, and more preferably at least about 700. The type (a) detergent/dispersant is preferably a succinimide of a hydrocarbyl polyamine or a polyoxyalkylene polyamine. The type (b) detergent/dispersant is preferably a polyisobutenyl polyamine. The type (c) detergent/dispersant is preferably a condensation product of (1) a high molecular weight sulfur-free alkyl-substituted hydroxyaromatic compound wherein the alkyl group has a number average molecular weight of from about 600 to about 3000, more preferably in the range of about 750 to about 1200, (2) an amine, preferably a polyamine, which contains an amino group having at least one active hydrogen atom, and (3) an aldehyde, preferably formaldehyde or a formaldehyde-forming reagent or formaldehyde precursor such as a reversible polymer of formaldehyde, wherein the molar ratio of reactants (1) : (2) : (3) is 1: 0.1–10: 0.1–10.

The cyclopentadienyl complex or compound is preferably a fuel-soluble dicyclopentadienyl iron compound and most preferably a fuel-soluble cyclopentadienyl manganese tricarbonyl compound. However other fuel-soluble cyclopentadienyl transition metal complexes or compounds can be used.

Accordingly, one of the embodiments of this invention is a hydrocarbonaceous distillate fuel, such as a diesel fuel, and preferably a gasoline fuel (including so-called reformulated or oxygenated gasolines) containing the combination of (i) at least one fuel-soluble detergent/dispersant selected from the group consisting of (a) fuel-soluble salts, amides, imides, oxazolines and esters, or mixtures thereof of long chain aliphatic hydrocarbon-substituted dicarboxylic acids or their anhydrides, (b) long chain aliphatic hydrocarbons having a polyamine attached directly thereto, and (c) Mannich condensation products formed by condensing a long chain aliphatic hydrocarbon-substituted phenol with an aldehyde, preferably formaldehyde, and an amine, preferably a polyamine; wherein the long chain hydrocarbon group in (a), (b) and (c) is a polymer of at least one $C_2$ to $C_{10}$ monoolefin, preferably at least one $C_2$ to $C_5$ monoolefin, and most preferably at least one $C_3$ to $C_4$ monoolefin, said polymer having a number average molecular weight of at least about 300, preferably at least about 400, and more preferably at least about 700, or (d) a combination of any two or all three of (a), (b) and (c); (ii) at least one fuel-soluble cyclopentadienyl complex of a transition metal, and (iii) at least one fuel-soluble liquid carrier or additive inductibility aid.

Another embodiment is a fuel additive concentrate comprising the combination of (i), (ii) and (iii) as described in the immediately preceding paragraph.

Still another embodiment is the method of inhibiting deposit formation in the fuel induction system of an internal combustion engine, which comprises providing or using as the fuel for such engine a hydrocarbonaceous distillate fuel, such as a diesel fuel, and preferably a gasoline fuel (including so-called reformulated or oxygenated gasolines) containing the combination of (i), (ii) and (iii) as described in the penultimate paragraph above.

These and other embodiments of this invention will be apparent from the ensuing description and ensuing claims.

Component (i)

The detergent/dispersant has an aliphatic chain (saturated or olefinically unsaturated) which contains an average of at least about 20, preferably at least about 30, and more preferably at least about 50 carbon atoms to provide the fuel solubility and stability required to function effectively as a detergent/dispersant. Typically the long chain aliphatic group will contain as many as 150 or 250 or even more carbon atoms. The long chain aliphatic group of the detergent/dispersant is derived from a mixture of aliphatic hydrocarbons such as polypropenes, polybutenes, polyisobutenes, polyamylenes, etc. The aliphatic chain of the detergent/dispersant is usually a hydrocarbyl group, but it may be a substituted hydrocarbyl group wherein the substituents are certain oxygen-based substituents such as ether oxygen linkages, keto groups (i.e., a carbonyl group bonded to two different carbon atoms), and/or hydroxyl groups.

The detergent/dispersants are typically formed from an aliphatic polyamine although in some cases useful products can be formed from aromatic polyamines. In this connection, the term "aliphatic polyamine" includes both open chain compounds (linear or branched) and ring compounds in which the ring is not aromatic in character. Thus the polyamine can be, for example an open chain polyamine such as diethylene triamine, tris(2-aminoethyl) amine, or hexamethylene diamine, or it can be a nonaromatic cyclic polyamine such as piperazine or N-(2-aminoethyl) piperazine. In addition, the polyamine can be a polyoxyalkylene polyamine such as are available commercially under the Jeffamine trade designation.

Polyamines which may be employed in forming the detergent/dispersant include any that have at least one amino group having at least one active hydrogen atom. A few representative examples include branched-chain alkanes containing two or more primary amino groups such as tetraamino-neopentane, etc.; polyaminoalkanols such as 2-(2-aminoethylamino) -ethanol and 2- [2-(2-aminoethylamino)-ethylamino]-ethanol; heterocyclic compounds containing two or more amino groups at least one of which is a primary amino group such as 1-(β-aminoethyl)-2-imidazolidone, 2-(2-aminoethylamino)-5-nitro-pyridine, 3 -amino-N-ethylpiperidine, 2-(2-aminoethyl)-pyridine, 5-aminoindole, 3-amino-5-mercapto-1,2,4-triazole, and 4- (aminomethyl)-piperidine; and the alkylene polyamines such as propylene diamine, dipropylene triamine, di-(1,2- butylene)triamine, N-(2-amino-ethyl) -1,3-propanediamine, hexamethylenediamineandtetra-(1,2-propylene)-pentamine.

Preferred amines are the alkylene polyamines, especially the ethylene polyamines which can be depicted by the formula $$H_2N(CH_2CH_2NH)_nH \qquad \text{I}$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. Commercially available ethylene polyamine mixtures usually contain minor amounts of branched species and cyclic species such as N-aminoethyl piperazine, N,N'-bis(aminoethyl)piperazine, N,N'-bis (piperazinyl)ethane, and like compounds. Typical commercial mixtures have approximate overall compositions falling in the range corresponding to diethylene triamine to pentaethylene hexamine. Methods for the production of polyalkylene polyamines are known and reported in the literature. See for example U.S. Pat. No. 4,827,037 and references cited therein, all disclosures of such patent and cited references being incorporated herein by reference.

Generally speaking, mixtures of alkylene polyamines such as propylene polyamines and ethylene polyamines suitable for forming the detergent/dispersants will typically contain an average of about 1.5 to about 10 and preferably an average of about 2 to about 7 nitrogen atoms per molecule. Accordingly, preferred polyamines used in the synthesis reaction for forming the detergent/dispersants for gasoline are preferably (1) diethylene triamine, (2) a combination of ethylene polyamines which approximates diethylene triamine in overall composition, (3) triethylene tetramine, (4) a combination of ethylene polyamines which approximates triethylene tetramine in overall composition, or (5) a combination of any two or three of, or of all four of (1), (2), (3) and (4). Ordinarily this reactant will comprise a commercially available mixture having the general overall composition approximating that of triethylene tetramine but which can contain minor amounts of branched-chain and cyclic species as well as some linear polyethylene polyamines such as diethylene triamine and tetraethylene pentamine. For best results, such mixtures should contain at least 50% and preferably at least 70% by weight of the linear polyethylene polyamines enriched in triethylene tetramine. In general, the ethylene polyamine mixtures known commercially as "diethylene triamine" will contain an average in the range of about 2.5 to about 3.5 nitrogen atoms per molecule. The commercially available ethylene polyamine mixtures known as "triethylene tetramines" will usually contain an average in the range of about 3.5 to about 4.5 nitrogen atoms per molecule.

Preferred polyamines used in forming the detergent/dispersant for use in middle distillate fuels such as diesel fuel are (1) triethylene tetramine, (2) a combination of ethylene polyamines which approximates triethylene tetramine in overall composition, (3) tetraethylene pentamine, (4) a combination of ethylene polyamines which approximates tetraethylene pentamine in overall composition, (5) pentaethylene hexamine, (6) a combination of ethylene polyamines which approximates pentaethylene hexamine in overall composition, or (7) a combination of any two; any three, any four, any five or all six of (1), (2), (3), (4), (5) and (6). Detergent/dispersants formed from diethylene triamine or mixtures of ethylene polyamines which approximate diethylene triamine in overall composition can also be effectively used in the middle distillate fuels of this invention.

As noted above, this invention employs any of three types of detergent/dispersants, namely (a) long-chain dibasic acid derivatives, most notably succinimides, (b) long-chain aliphatic polyamines, and (c) long-chain Mannich bases, or combinations thereof.

(a) Succinimide Detergent/Dispersants.

The preferred succinimide detergent/dispersants for use in gasolines are prepared by a process which comprises reacting (A) an ethylene polyamine selected from (1) diethylene triamine, (2) a combination of ethylene polyamines which approximates diethylene triamine in average overall composition, (3) triethylene tetramine, (4) a combination of ethylene polyamines which approximates triethylene tetramine in average overall composition, or (5) a mixture of any two or more of (1) through (4), with (B) at least one acyclic hydrocarbyl substituted succinic acylating agent. The substituent of such acylating agent is characterized by containing an average of about 50 to about 100 (preferably about 50 to about 90 and more preferably about 64 to about 80) carbon atoms. Additionally, the acylating agent has an acid number in the range of about 0.7 to about 1.3 (e.g., in the range of 0.9 to 1.3, or in the range of 0.7 to 1.1), more preferably in the range of 0.8 to 1.0 or in the range of 1.0 to 1.2, and most preferably about 0.9. The detergent/dispersant contains in its molecular structure in chemically combined form an average of from about 1.5 to about 2.2 (preferably from 1.7 to 1.9 or from 1.9 to 2.1, more preferably from 1.8 to 2.0, and most preferably about 1.8) moles of said acylating agent, (B), per mole of said polyamine, (A).

The acid number of the acyclic hydrocarbyl substituted succinic acylating agent is determined in the customary way—i.e., by titration—and is reported in terms of mg of KOH per gram of product. It is to be noted that this determination is made on the overall acylating agent with any unreacted olefin polymer (e.g., polyisobutene) present.

The acyclic hydrocarbyl substituent of the detergent/dispersant is preferably an alkyl or alkenyl group having the requisite number of carbon atoms as specified above. Alkenyl substituents derived from poly-α-olefin homopolymers or copolymers of appropriate molecular weight (e.g., propene homopolymers, butene homopolymers, $C_3$ and $C_4$ α-olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000. The established manufacturers of such polymeric materials are able to adequately identify the number average molecular weights of their own polymeric materials. Thus in the usual case the nominal number average molecular weight given by the manufacturer of the material can be relied upon with considerable confidence.

Acyclic hydrocarbyl-substituted succinic acid acylating agents and methods for their preparation and use in the formation of succinimide are well known to those skilled in the art and are extensively reported in the patent literature. See for example the following U.S. Patents.

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |

-continued

| | | |
|---|---|---|
| 3,202,678 | 3,361,673 | 4,110,349 |
| 3,215,707 | 3,373,111 | 4,234,435 |
| 3,219,666 | 3,381,022 | 5,071,919 |

When utilizing the general procedures such as described these patents, the important considerations insofar as the present invention is concerned, are to insure that the hydrocarbyl substituent of the acylating agent contain the requisite number of carbon atoms, that the acylating agent have the requisite acid number, that the acylating agent be reacted with the requisite polyethylene polyamine, and that the reactants be employed in proportions such that the resultant succinimide contains the requisite proportions of the chemically combined reactants, all as specified herein. When utilizing this combination of features, detergent/dispersants are formed which possess exceptional effectiveness in controlling or reducing the amount of induction system deposits formed during engine operation and which permit adequate demulsification performance.

As pointed out in the above listed patents, the acyclic hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

The acylating agent for producing the detergent/dispersants is preferably made by reacting a polyolefin of appropriate molecular weight (with or without chlorine) with maleic anhydride. However, similar carboxylic reactants can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The reaction between the polyamine and the acylating agent generally conducted at temperatures of 80° C. to 200° C., more preferably 140° C. to 180° C., such that a succinimide is formed. These reactions may be conducted in the presence or absence of an ancillary diluent or liquid reaction medium, such as a mineral lubricating oil solvent. If the reaction is conducted in the absence of an ancillary solvent, such is usually added to the reaction product on completion of the reaction. In this way, the final product is more readily handled, stored and blended with other components. Suitable able solvent oils include natural and synthetic base oils having a viscosity (ASTM D 445) of preferably 3 to 12 $mm^2$/ sec at 100° C. with the primarily paraffinic mineral oils such as a 500 Solvent Neutral oil being particularly preferred. Suitable synthetic diluents include polyesters, hydrogenated or unhydrogenated poly-α-olefins (PAO) such as hydrogenated or unhydrogenated 1-decene oligomer, and the like. Blends of mineral oil and synthetic oils are also suitable for this purpose.

As used herein, the term "succinimide" is meant to encompass the completed reaction product from the polyamine and the acylating agent, and is intended to encompass compounds wherein the product may have amide, amidine, and/or salt linkages in addition to the imide linkage of the type that results from the reaction of a primary amino group and an anhydride moiety.

(b) Aliphatic Polyamine Detergent/Dispersants

These detergent/dispersants are known materials prepared by known process technology. One common process involves halogenation of a long chain aliphatic hydrocarbon such as a polymer of ethylene, propylene, butylene, isobutene, amylene, or copolymers such as ethylene and propylene, butylene and isobutylene, and the like, followed by reaction of the resultant halogenated hydrocarbon with a polyamine. If desired, at least some of the product can be converted into an amine salt by treatment with an appropriate quantity of an acid. The products formed by the halogenation route often contain a small amount of residual halogen such as chlorine. Another way of producing suitable aliphatic polyamines involves controlled oxidation (e.g., with air or a peroxide) of a polyolefin such as polyisobutene followed by reaction of the oxidized polyolefin with a polyamine. For synthesis details for preparing such aliphatic polyamine detergent/dispersants, see for example U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; 5,086,115; 5,112,364; and 5,124,484; and published European Patent Application 384,086. The disclosures of each of the foregoing documents are incorporated herein by reference, as the additives therein described are deemed suitable for the practice of this invention. The long chain substituent(s) of the detergent/dispersant most preferably contain(s) an average of 50 to 350 carbon atoms in the form of alkyl or alkenyl groups (with or without a small residual amount of halogen substitution). Alkenyl substituents derived from poly-α-olefin homopolymers or copolymers of appropriate molecular weight (e.g., propene homopolymers, butene homopolymers, $C_3$ and $C_4$ α-olefin copolymers, and the like) are suitable. Most preferably, the substituent is a polyisobutenyl group formed from polyisobutene having a number average molecular weight (as determined by gel permeation chromatography) in the range of 500 to 2000, preferably 600 to 1800, most preferably 700 to 1600. The established manufacturers of such polymeric materials are able to adequately identify the number average molecular weights of their own polymeric materials. Thus in the usual case the nominal number average molecular weight given by the manufacturer of the material can be relied upon with considerable confidence.

(c) Mannich Base Detergent/Dispersants

While various fuel-soluble long chain Mannich base dispersants formed from a long chain alkylphenol, formaldehyde or a formaldehyde precursor (i.e., a reversible polymer of formaldehyde, also sometimes called a formaldehyde-forming reagent) and a polyamine can be used, the Mannich base detergent/dispersants described in U.S. Pat. No. 4,231,759 are most preferred for use in the practice of this invention. Since this patent fully describes the materials used in the synthesis of the detergent/dispersants, and the process conditions and other details relating to the preparation of such detergent/dispersants, U.S. Pat. No. 4,231,759 is incorporated herein in toto by reference.

It will of course be understood that if desired, components (a) , (b) and/or (c) can be post-treated with various post agents. Technology of this type is well known and extensively reported in the literature. Thus use can be made of post-treating: technology such as described for example in U.S. Pat. Nos. 3,036,003, 3,087,936, 3,184,411, 3,185,645, 3,185,647, 3,185,704, 3,189,544, 3,200,107, 3,216,936, 3,245,908, 3,245,909, 3,245,910, 3,254,025, 3,256,185, 3,278,550, 3,280,034, 3,281,428, 3,282,955, 3,284,409, 3,284,410, 3,312,619, 3,338,832, 3,342,735, 3,344,069, 3,366,569, 3,367,943, 3,369,021, 3,373,111, 3,390,086, 3,403,102, 3,415,750, 3,428,561, 3,442,808, 3,455,831, 3,455,832, 3,458,530, 3,470,098, 3,493,520, 3,502,677, 3,511,780, 3,513,093, 3,519,564, 3,533,945, 3,539,633, 3,541,012, 3,546,243, 3,551,466, 3,558,743, 3,573,010, 3,573,205, 3,579,450, 3,591,598, 3,600,372, 3,639,242 3,649,229, 3,649,659, 3,652,616, 3,658,836, 3,692,681, 3,697,574, 3,702,757, 3,703,536, 3,704,308, 3,708,522, 3,718,663, 3,725,480, 3,726,882, 3,749,695, 3,791,805, 3,859,318, 3,865,740, 3,865,813, 3,903,151, 3,954,639, 4,014,803, 4,025,445, 4,140,492, 4,234,435, 4,306,984, 4,379,064, 4,455,243, 4,482,464, 4,483,775, 4,521,318, 4,548,724, 4,554,086, 4,579,675, 4,612,132, 4,614,522, 4,614,603, 4,615,826, 4,617,137, 4,617,138, 4,631,070, 4,636,322, 4,645,515, 4,647,390, 4,648,886, 4,648,980, 4,652,387, 4,663,062, 4,663,064 4,666,459, 4,666,460, 4,668,246, 4,699,724, 4,670,170, 4,713,189 4,713,191, 4,857,214, 4,927,562, 4,948,386, 4,963,275, 4,963,278, 4,971,598, 4,971,711, 4,973,412, 4,981,492, 4,985,156, 5,026,495, 5,030,249, 5,030,369, 5,039,307, and 5,039,310, the disclosures which are incorporated herein.

Component (ii)

It will be recalled that component (ii) of the compositions of this invention is one or more fuel-soluble cyclopentadienyl complexes (compounds) of a transition metal. Reference herein to "transition metal" means those elements of the periodic system characterized by atoms in which an inner d level of electrons is present but not filled to capacity, namely, Sc, Ti, V, Cr, Mn, Fe, Co, Ni, Y, Zr, Nb, Mo, Tc, Ru, Rh, Pd, La, Hf, Ta, W, Re, Os, Ir, Pt, and Ac. From the standpoints of cost, availability and performance, the preferred transition metals for such compounds are those having atomic numbers 22–28, 40, 42, 44, and 74, i.e., Ti, V, Cr, Mn, Fe, Co, Ni, Zr, Mo, Ru, and W. Of these, the cyclopentadienyl derivatives of Mn, Fe, Co, and Ni are preferred. Particularly preferred are the fuel-soluble cyclopentadienyl derivatives of iron and manganese. The most preferred component (ii) materials are the cyclopentadienyl manganese tricarbonyl compounds.

The presence of at least one cyclopentadienyl group bonded to an atom of transition metal in the component (ii) transition metal compound is deemed highly important. Without desiring to be bound by theoretical considerations, the existing scientific evidence tends strongly to indicate that a cyclopentadienyl group or moiety forms coordinate covalent bonding with the transition metal atom and thereby confers thermal stability to the resultant compound or complex. For example, in the case of ferrocene and ring-alkyl substituted ferrocenes, it is generally understood that a "sandwich" structure exists wherein an atom of iron is interposed between and covalently coordinated with two cyclopentadienyl and/or alkyl-substituted cyclopentadienyl groups. Besides being fuel soluble, such compounds possess a high degree of thermal stability. A similar situation prevails in the case of cyclopentadienyl manganese tricarbonyl compounds. Here, a manganese atom is covalently coordinated with a cyclopentadienyl or indenyl group or an alkyl-substituted cyclopentadienyl or indenyl group. In addition, three carbonyl groups are bonded to the manganese atom to provide a fuel-soluble, thermally stable organometallic compound having what has been described as a "piano stool" structure.

The bonding between the cyclopentadienyl-moiety containing group(s) and the transition metal atom is generally regarded as "pi-bonding", and this is a characteristic which is believed to contribute to the ability of the component (ii) compounds to cooperate so effectively with and improve the performance of the component (i) detergent/dispersants. One may theorize that because of this bonding the transition metal complex is able to survive the thermal environment in the engine long enough to be able to cooperate in some presently-unexplainable manner with the detergent/dispersant to achieve the surprising benefits obtainable by the practice of this invention. Thus while the prior art contains teachings to employ detergent/dispersants in fuel and teachings to employ cyclopentadienyl transition metal compounds in fuel, no one skilled in the art could possibly have dreamed, let alone found it obvious, that a combination of components (i) and (ii) could provide the striking and highly important benefits that accrue from the practice of this invention. In short, the present invention provides totally unexpected, unforeseen results that could not have been predicted from prior knowledge, as will be seen from the data presented hereinafter.

As used herein, "cyclopentadienyl complex of a transition metal" means a compound ("compound" and "complex" being used interchangeably in this context) in which at least one cyclopentadienyl moiety-containing group is bonded (pi-bonded) to an atom of the transition metal. Other electron-donating groups such as carbonyl, nitrosyl, hydride or the like can also be bonded to the transition metal compound to provide a compound having suitable fuel solubility, engine inductibility and thermal stability. The cyclopentadienyl moiety-containing group can be depicted as follows:

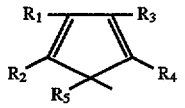

II where each of $R_1$, $R_2$, $R_3$, $R_4$, and $R_5$ is, independently, a hydrogen atom or a hydrocarbyl group (usually but not exclusively, alkyl, alkenyl, cycloalkyl, aryl or aralkyl), and where $R_3$ and $R_4$ taken together can form an aryl or hydrocarbyl-substituted aryl group fused onto the cyclopentadienyl group as, for example in the case of an indenyl group:

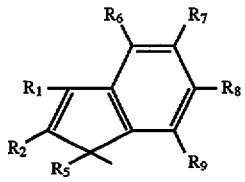

III where each of $R_1$, $R_2$, $R_5$, $R_6$, $R_7$, $R_8$, and $R_9$ is, independently, a hydrogen atom or a hydrocarbyl group (usually but not exclusively alkyl, alkenyl, cycloalkyl, aryl or aralkyl).

One preferred type of cyclopentadienyl complex of a transition metal is comprised of compounds of the general formula:

AMB where M is a transition metal, especially iron, cobalt or nickel, and A and B are preferably the same, but can be different from each other, and are hydrocarbyl cyclopentadienyl moiety-containing groups which have from 5 to about 24 carbon atoms, and more preferably from 5 to about 10 carbon atoms each. A few illustrative examples include biscyclopentadienyl iron, (i.e., ferrocene), clopentadienyl methylcyclopentadienyl iron (i.e., monomethyl ferrocone), bis(methylcyclopentadienyl) iron (i.e., ferrocene in which both rings each has a methyl substituent), cyclopentadienyl ethylcyclopentadienyl iron, bis(ethylcyclopentadienyl) iron, bis(dimethylcyclopentadienyl) iron, bis (trimethylcyclopentadienyl) iron, cyclopentadienyl tert-butylcyclopentadienyl iron, bis (pentamethylcyclopentadienyl) iron, methylcyclopentadienyl ethylcyclopentadienyl iron, bis (hexylcyclopentadienyl) iron, bisindenyl iron, biscyclopentadienyl nickel (i.e, nickelocene), cyclopentadienyl methylcyclopentadienyl nickel, bis(methylcyclopentadienyl) nickel bis-(isopropylcyclopentadienyl) nickel, bisindenyl nickel, biscyclopentadienyl cobalt, bis (methylcyclopentadienyl) cobalt, bis (dimethylcyclopentadienyl) cobalt, and the like. Of these compounds, ferrocene and monoalkyl- and dialkyl-substituted ferrocenes (each alkyl group having up to 6 carbon atoms) are more preferred, with ferrocene and the methylferrocenes being most preferred.

Another preferred type of cyclopentadienyl complex of a transition metal is composed of compounds of the general formula:

$A_zMC_xD_y$ where A is a cyclopentadienyl group such as depicted above in formulas (II) and (III) and having from 5 to about 24 carbon atoms and more preferably from 5 to about 10 carbon atoms; M is a transition metal, especially manganese, iron, cobalt, and nickel; C and D are electron donating groups (carbonyl, nitrosyl, hydride, hydrocarbyl, nitrilo, amino, trihydrocarbylamino, trihaloamino, trihydrocarbyl phosphite, trihalophosphine, 1,3-diene, etc.); z is a whole integer from 1 to 2; x is a whole integer from 1 to 4, and y is a whole integer from 0 to 4, and where C and D, when both are present, differ from each other and the sum of the electrons donated by C (and D when present) when added to 5 being equal to the atomic number of an inert gas whose atomic number is above, but closest to, the atomic number of the transition metal, M. Note in this connection, U.S. Pat. No. 2,818,416.

Illustrative examples of such cyclopentadienyl complexes of a transition metal are cyclopentadienyl manganese benzene; methylcyclopentadienyl manganese (dicarbonyl) (tetrahydrofuran); methylcyclopentadienyl manganese (dicarbonyl) (methyltetrahydrofuran); methylcyclopentadienyl manganese (dicarbonyl) (tin dichloride); methylcyclopentadienyl manganese (dicarbonyl) (acetylacetonate); cyclopentadienyl manganese (dicarbonyl) (4-vinylpyridine); methylcyclopentadienyl manganese (dicarbonyl) (4-vinylpyridine); cyclopentadienyl manganese (dicarbonyl) (triphenylphosphine); methylcyclopentadienyl manganese (dicarbonyl) (triphenylphosphine); cyclopentadienyl manganese (carbonyl) di(tetrahydrofuran); methylcyclopentadienyl manganese (dicarbonyl) (alkanol) where the alkanol is methanol or ethanol or mixtures thereof; cyclopentadienyl iron (dicarbonyl) (iodide); cyclopentadienyl iron (carbonyl) (iodide) (methyltetrahydrofuran); cyclopentadienyl cobalt dicarbonyl; cyclopentadienyl nickel nitrosyl, methylcyclopentadienyl nickel nitrosyl, and the like.

The most preferred component (ii) compounds are the cyclopentadienyl manganese tricarbonyl compounds such as cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, for example, U.S. Pat. No. 2,818,417, the disclosure of which is incorporated herein in toto.

Component (iii)

As pointed out above, the compositions of this invention also contain a carrier fluid (also known as a solvent, diluent, or induction aid). Useful as carrier fluids or induction aids are such materials as liquid poly-α-olefin oligomers, liquid polyalkene hydrocarbons (e.g., polypropene, polybutene, polyisobutene, or the like), liquid hydrotreated polyalkene hydrocarbons (e.g., hydro-treated polypropene, hydrotreated polybutene, hydrotreated polyisobutene, or the like), mineral oils, liquid polyoxyalkylene compounds, liquid alcohols or polyols, liquid esters, and similar liquid carriers or solvents. Mixtures of two or more such carriers or solvents can be employed.

In the practice of this invention particular types of carrier fluids are especially preferred because of their performance capabilities, but others can also be used. The preferred carrier fluids are 1) one or a blend of mineral oils having a viscosity index of less than about 90 and a volatility of 50% or less as determined by the test method described below, 2) one or a blend poly-α-olefins having a volatility of 50% or less as determined by the test method described below, 3) one or more polyoxyalkylene compounds having an average molecular weight of greater than about 1500, or 4) a mixture of any two or all three of 1), 2) and 3). Preferred are blends of 1) and 2), and blends of 1) and 3).

The test method used for determination of volatility in connection with the carrier fluids of 1) and 2) above is as follows: Mineral oil or poly-α-olefin (110–135 grams) is placed in a three-neck, 250 mL round-bottomed flask having a threaded port for a thermometer. Such a flask is available from Ace Glass (Catalog No. 6954-72 with 20/40 fittings). Through the center nozzle of the flask is inserted a stirrer rod having a Teflon blade, 19 mm wide ×60 mm long (Ace Glass catalog No. 8085-07). The mineral oil is heated in an oil bath to 300° C. for 1 hour while stirring the oil in the flask at a rate of 150 rpm. During the heating and stirring, the free space above the oil in the flask is swept with 7.5 L/hr of air or inert gas (e.g., nitrogen, argon, etc.). The volatility of the fluid thus determined is expressed in terms of the weight percent of material lost based on the total initial weight of material tested.

As noted above, one type of preferred carrier fluid is one or a blend of mineral oils having a viscosity index of less than about 90 and a volatility of 50% or less as determined by the test method described above. Mineral oils having such volatilities that can be used include naphthenic and asphaltic oils. These often are derived from coastal regions. Thus a typical Coastal Pale may contain about 3–5 wt. % polar material, 20–35 wt. % aromatic hydrocarbons, and 50–75 wt. % saturated hydrocarbons and having a molecular weight in the range of from about 300 to about 600. Asphaltic oils usually contain ingredients with high polar functionality and little or no pure hydrocarbon type compounds. Principal polar functionalities generally present in such asphaltic oils include carboxylic acids, phenols, amides, carbazoles, and pyridine benzologs. Typically, asphaltenes contain about 40–50% by weight aromatic carbon and have molecular weights of several thousand. Preferably the mineral oil used has a viscosity at 100° F. of less than about 1600 SUS more preferably less than about 1500 SUS, and most preferably between about 800 and 1500 SUS at 100° F. For best results it is highly desirable that the mineral oil have a viscosity index of less than about 90, more particularly, less than about 70 and most preferably in the range of from about 30 to about 60. The mineral oils may be solvent extracted or hydrotreated oils, or they may be non-hydrotreated oils. The hydrotreated oils are the most preferred type of mineral oils used as carrier fluids in the practice of this invention.

Another preferred type of carrier fluid is one or a blend of paraffinic mineral oils of suitable viscosity range, typically in the range of about 300 SUS at 40° C. to about 700 SUS at 40° C., and preferably in the range of about 475 SUS at 40° C. to about 625 SUS at 40° C. Such oils can be processed by standard refining procedures such as solvent refining, and the like. Thus, effective use can be made of paraffinic base solvent neutral mineral oils in the range of about 350N to about 700N and preferably in the range of about 500N to about 600N.

The poly-α-olefins (PAO) which are included among the preferred carrier fluids of this invention are the hydroteated and unhydrotreated poly-α-olefin oligomers, i.e., hydrogenated or unhydrogenated products, primarily trimers, tetramers and pentamers of α-olefin monomers, which monomers contain from 6 to 12, generally 8 to 12 and most preferably about 10 carbon atoms. Their synthesis is outlined in Hydrocarbon Processing. February 1982,page 75 et seq. and is described in the patents cited hereinafter in this paragraph. The usual process essentially comprises catalytic oligomerization of short chain linear alpha olefins (suitably obtained by catalytic treatment of ethylene). The nature of an individual PAO depends in part on the carbon chain length of the original α-olefin, and also on the structure of the oligomer. The exact molecular structure may vary to some extent according to the precise conditions of the oligomerization, which is reflected changes in the physical properties of the final PAO, particularly its viscosity. Typically, the poly-α-olefins used have a viscosity (measured at 100° C.) in the range of 2 to 20 centistokes (cSt). Preferably, the poly-α-olefin has a viscosity of at least 8 cSt, and most preferably about 10 cSt at 100° C. The hydrotreated poly-α-olefin oligomers are readily formed by hydrogenating poly-α-olefin oligomers using conditions such as are described in U.S. Pat. Nos. 3,763,244; 3,780,128; 4,172,855; 4,218,330; and 4,950,822, the entire disclosures of which are incorporated herein by reference.

The polyoxyalkylene compounds which are among the preferred carrier fluids for use in this invention are fuel-soluble compounds which can be represented by the following formula $$R_1—(R_2—O)_n—R_3 \qquad \text{IV}$$

wherein $R_1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R_2$ is an alkylene group having 2–10 carbon atoms (preferably 2–4 carbon atoms), $R_3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 representing the number of repeating alkoxy groups. Preferred polyoxyalkylene compounds are comprised of repeating units formed by reacting an alcohol with an alkylene oxide wherein the alcohol and alkylene oxide contain the same number of carbon atoms.

One useful sub-group of polyoxyalkylene compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being incorporated herein by reference as if fully set forth.

A most preferred sub-group of polyoxyalkylene compounds is made up of compounds of formula IV above wherein the repeating units are comprised substantially of $C_3H_6$—O, and wherein $R_1$ is a hydroxy group and $R_3$ is a hydrogen atom. Polyoxyalkylene compounds useful for this invention which are commercially available include Polyglycol P-1200, Polyglycol L1150, Polyglycol P-400, etc. which are available from the Dow Chemical Company.

The average molecular weight of the polyoxyalkylene compounds used as carrier fluids is preferably in the range of from about 200 to about 5000, more preferably from about 1000 to about 4500, and most preferably from above about 1500 to about 4000. For purposes of this invention, the end groups, $R_1$ and $R_3$, are not critical as long as the overall polyoxyalkylene compound is sufficiently soluble in the fuel compositions and additive concentrates of this invention at the desired concentration to provide homogeneous solutions that do not separate at low temperatures such as −20° C.

The polyoxyalkylene compounds that can be used in practicing this invention may be prepared by condensation of the corresponding alkylene oxides, or alkylene oxide mixtures, such as ethylene oxide, 1,2-propylene oxide, 1,2-butylene oxide, etc. as set forth more fully in U.S. Pat. Nos. 2,425,755; 2,425,845; 2,448,664; and 2,457,139, which documents are incorporated herein by reference as if fully set forth.

Another group of preferred carriers is the liquid polyalkylenes such as polypropenes, polybutenes, polyisobutenes, polyamylenes, copolymers of propene and butene, copolymers of butene and isobutene, copolymers of propene and isobutene, copolymers of propene, butene and isobutene, and the like. Use of materials of this general type together with other carrier fluids is described for example, in U.S. Pat. Nos. 5,089,028 and 5,114,435, the disclosures of which are incorporated herein by reference.

In some cases, the detergent/dispersants can be synthesized in the carrier fluid. In other instances, the preformed detergent/dispersant is blended with a suitable amount of the carrier fluid. If desired, the detergent/dispersant can be formed in a suitable solvent or carrier fluid and then blended with an additional quantity of the same or a different carrier fluid to product the product used as component (i) in the practice of this invention. These and other variants will readily occur to those skilled in the art.

Proportions

The proportion of the cyclopentadienyl metal complex or compound such as a ferrocene compound or a cyclopentadienyl manganese tricarbonyl compound used in the compositions of this invention is such that the resultant composition when consumed in an engine results in improved intake valve cleanliness as compared intake valve cleanliness of the same engine operated on the same composition except for being devoid of cyclopentadienyl metal compound. Thus in general, the weight ratio of detergent/dispersant to metal in the form of cyclopentadienyl metal compound will usually fall within the range of about 3:1 to about 100:1, and preferably within the range of about 6:1 to about 50:1. For the purpose of ascertaining these ratios, the weight of the detergent/dispersant is the weight of the product as produced including unreacted polyolefin associated with the product as produced together with process diluent oil, if any, used during the production process to facilitate the reaction, but excluding the weight of any additional diluent that may be added to the detergent/dispersant after it has been produced, and of course excluding the weight of the carrier fluid component (iii).

Typically the additive compositions of this invention contain from about 5 to about 50 wt %, and preferably from about 10 to about 25 wt % of the long chain active detergent/dispersant and from about 1 to about 15 wt %, and preferably from about 3 to about 10 wt % of cyclopentadienyl transition metal compound with the balance of the composition consisting essentially of the liquid carrier, diluent, solvent, or induction aid (however it be named). Here again, the weight of the detergent/dispersant is the weight of the product as produced including unreacted polyolefin associated with the product as produced, if any, together with process diluent oil, if any, used during the production process to facilitate the reaction, but excluding the weight of any additional diluent that may be added to the detergent/dispersant after it has been produced. If desired, these compositions may contain small amounts (e.g., a total of up to about 10 wt % and preferably a total of up to about 5 wt % based on the total weight of the additive composition), of one or more fuel-soluble antioxidants, demulsifying agents, rust or corrosion inhibitors, metal deactivators, marker dyes, and the like.

When formulating the fuel compositions of this invention, the additives are employed in amounts sufficient to reduce or inhibit deposit formation in an internal combustion engine. Thus the fuels will contain minor amounts of the above additives (i), (ii) and (iii)—i.e., detergent/dispersant, cyclopentadienyl transition metal compound, carrier fluid—that control or reduce formation of engine deposits, especially intake system deposits, and most especially intake valve deposits in spark-ignition internal combustion engines. Generally speaking the fuels of this invention will contain an amount of the detergent/dispersant, component (i), in the range of about 20 to about 500 ppm, and preferably in the range of about 100 to about 400 ppm; an amount of transition metal in the form of a cyclopentadienyl transition metal complex or compound, component (ii), in the range of about 0.0078 to about 0.25 gram of transition metal per gallon, and preferably in the range of about 0.0156 to about 0.125 gram of transition metal per gallon; and an amount of carrier fluid, component (iii), in the range of about 20 to about 2000 ppm, and preferably in the range of about 100 to about 1200 ppm.

The optimum proportions of the carrier fluid used depend to some extent on the identity of the carrier fluid. When using mineral oil fluids or poly-α-olefin carrier fluids (hydrotreated or unhydrotreated) or mixtures of the mineral oil fluids and the PAO; the amount of carrier fluid will preferably correspond to a weight ratio of detergent/dispersant to carrier fluid in the range of about 0.3:1 to about 1:1. When using one or more polyoxyalkylene compounds either alone or in admixture with a mineral oil carrier, the amount of carrier fluid preferably corresponds to a weight ratio of the detergent/dispersant to the carrier fluid falling in the range of about 0.05:1 to about 0.5: 1. When using a combination of the mineral oil, the unhydrotreated poly-α-olefin and the polyoxyalkylene compound, the carrier fluid is preferably proportioned to yield a weight ratio of the detergent/dispersant to the total carrier fluid falling in the range of about 0.25: 1 to about 1: 1. Departures can be made from any of the foregoing ranges of proportions whenever deemed necessary or desirable without departing from the spirit and scope of this invention, the foregoing ranges of proportions constituting preferred ranges based on presently-available information. It is to be noted that the foregoing proportions are based on the weight of process diluent oil, if any, used during the production process to facilitate the reaction. However the weight of the detergent/dispersant does not include the weight of any additional diluent that may be added to the detergent/dispersant after it has been produced. Thus if using a purchased intake valve deposit control additive package, such as a succinimide, polyalkylene polyamine or Mannich base detergent/dispersant which contains a suitable carrier fluid, such as HiTEC® 4403, 4404 or 4450 additive (Ethyl Petroleum Additives, Inc.), the dosage used should take into consideration the fact that such products typically do contain a carrier fluid.

When a mixture of any two or all three types of the preferred carrier fluids is used, the proportions of the respective types of carrier fluids can vary over the entire range of relative proportions. For best results, however, the following proportions on a weight basis are recommended when using mixtures of two such carrier fluids:

For a mixture of 1) mineral oil and 2) hydrotreated or unhydrotreated poly-α-olefin, the weight ratio of 1) to 2) is preferably in the range of about 0.5:1 to about 3:1.

For a mixture of 1) mineral oil and 3) polyoxyalkylene compound, the weight ratio of 1) to 3) is preferably in the range of about 4:1 to about 7:1.

For a mixture of 2) hydrotreated or unhydrotreated poly-α-olefin and 3) polyoxyalkylene compound, the weight ratio of 2) to 3) is preferably in the range of about 0.25:1 to about 4:1.

The additives used in formulating the fuels of this invention can be blended into the base fuel individually or in various subcombinations. However, it is definitely preferable to blend all of the components concurrently using an additive concentrate of this invention as this takes advantage of the mutual compatibility afforded by the combination of ingredients when in the form of an additive concentrate. Also use of a concentrate reduces blending time and lessens the possibility of blending errors.

The surprising properties manifested by compositions of this invention were demonstrated by actual road tests conducted using a BMW 318i vehicle operated on a group of four test fuels. The base fuel used throughout this group of tests was Phillips J fuel. This fuel contains no detergent/dispersant and no added metal-containing compound. The vehicle was operated under the same conditions with new intake valves at the start of each test. After known mileage accumulation with a given test fuel, the intake valves were removed from the engine and the weight of the valve deposits was determined and averaged for the four intake valves. The four fuels tested in this manner were as follows:

Fuel A—Base fuel as received

Fuel B—Base fuel containing 250 pounds per thousand barrels (ptb) of an additive composition of Example 4 hereinafter except that the methylcyclopentadienyl manganese tricarbonyl was omitted Fuel C—Base fuel containing 0.03125 (i.e., 1/32) g/gal of manganese as methylcyclopentadienyl manganese tricarbonyl Fuel D—Base fuel containing 250 ptb of the additive composition used in Fuel B, and 0.03125g/gal of manganese as methylcyclopentadienyl manganese tricarbonyl Fuel D was thus representative of the compositions of this invention whereas Fuels A, B, and C were comparative fuels.

Table I summarizes the results of these tests, and Table II sets forth the inspection data of the base fuel used in these tests.

TABLE I

| Fuel Used | Miles of Operation | Average Intake Valve Weight, mg |
|---|---|---|
| Fuel A | 4,300 | 100 |
| Fuel B | 10,000 | 42 |
| Fuel C | 5,000 | 120 |
| Fuel D | 10,000 | 5 |

TABLE II

| Test Description | Final Result | ASTM Test Method |
|---|---|---|
| Distillation, Gasoline, °F. | | D86 |
| Initial Boiling Temperature | 86 | |
| 05% Evaporated Temperature | 107 | |
| 10% Evaporated Temperature | 124 | |
| 20% Evaporated Temperature | 140 | |
| 30% Evaporated Temperature | 159 | |
| 40% Evaporated Temperature | 187 | |
| 50% Evaporated Temperature | 217 | |
| 60% Evaporated Temperature | 237 | |
| 70% Evaporated Temperature | 256 | |
| 80% Evaporated Temperature | 284 | |
| 90% Evaporated Temperature | 329 | |
| 95% Evaporated Temperature | 368 | |
| End Point | 432 | |
| % Overhead Recovery | 97.4 | |
| % Residue | 1.0 | |
| % Loss | 1.6 | |
| Potential Gum Content, mg | | D873; D381 |
| Potential Residue, Precipitate | <0.1 | |
| Potential Residue, Insoluble Gum | 147.4 | |
| Potential Gum, Soluble Gum | 7.2 | |
| Potential Gum, Total Gum | 154.6 | |
| Acid Number, Total, mg KOH/g | <0.1 | D664 |
| Peroxides, Organic Assay, %/peroxide number | <0.01 | E 298-84 |
| Gravity, °API - 60/60 F. | 54.8 | D287 |
| Oxidation Stability, minutes | 1440 | D525 |
| Total Sulfur, ppm wt. | 199 | D3120 |
| Reid Vapor Pressure, PSI | 7.4 | D323 |
| Water, Karl Fischer Titration, ppm | 292 | D1744 |
| Gum Content, Washed, mg/100 mL | 0.4 | D381 |
| Gum Content, Unwashed, mg/100 mL | 2.0 | D381 |
| Lead Content, g/gal | <0.001 | D3237 |

In view of the astonishing results described in Table I above, additional tests were performed in a different BMW 318i fuel-injected vehicle. In these tests Fuel E corresponded to Fuel B above except that the additive composition was used at the level of 200 ptb rather than 250 ptb. In Fuel F, which was representative of the compositions of this invention, the base fuel contained 200 ptb of the additive composition used in Fuel B, and 0.03125 g/gal of manganese as methylcyclopentadienyl manganese tricarbonyl. Results from these tests at 5000 and 10,000 miles are summarized in Table III.

TABLE III

| Fuel Used | Miles of Operation | Average Intake Valve Weight, mg |
|---|---|---|
| Fuel E | 5,000 | 60 |
| Fuel E | 10,000 | 95 |
| Fuel F | 5,000 | 18 |
| Fuel F | 10,000 | 16 |

In another pair of tests using the above test procedure and the same base fuel, a comparison was made as between base fuel containing 200 ptb of a commercially-available polyisobutenyl polyamine composition (Fuel G) and the base fuel containing 200 ptb of the same commercially-available polyisobutenyl polyamine composition plus 0.03125 g/gal of manganese as methylcyclopentadienyl manganese tricarbonyl (Fuel H). Based on analyses of the polyisobutenyl polyamine composition, Fuels G and H contained approximately 44 ptb of the active polyisobutenyl polyamine detergent/dispersant and approximately 156 ptb of carrier fluid and solvent. Results from these tests at 5000 miles are summarized in Table IV. For ease of reference, the results on the same base fuel without additives (Fuel A) and the same base fuel containing 0.03125 g/gal of manganese as methylcyclopentadienyl manganese tricarbonyl (Fuel C) are also presented in Table IV.

TABLE IV

| Fuel Used | Miles of Operation | Average Intake Valve Weight, mg |
|---|---|---|
| Fuel A | 4,300 | 100 |
| Fuel C | 5,000 | 120 |
| Fuel G | 5,000 | 38 |
| Fuel H | 5,000 | 0 |

Another group of tests was conducted using a different commercially-available long chain succinimide-based detergent/dispersant composition (HiTEC® 4450 additive) with and without addition of 6.4 ppm of manganese as methylcyclopentadienyl manganese tricarbonyl. In these tests, the base fuel had the characteristics set forth in Table V.

TABLE V

| Test Description | Final Result |
|---|---|
| Hydrocarbon Composition, Volume % | |
| Aromatics | 36.6 |
| Olefins | 6.3 |
| Saturates | 57.1 |
| Distillation, Gasoline, °C. | |
| Initial Boiling Temperature | 31 |
| 10% Evaporated Temperature | 51 |
| 50% Evaporated Temperature | 104 |
| 90% Evaporated Temperature | 161 |
| End Point | 205 |
| % Overhead Recovery | 99 |
| Specific Gravity | 0.7574 |
| Total Sulfur, wt % | 0.04 max |
| Reid Vapor Pressure, PSI | 9.14 |
| Gum Content, Washed, mg/100 mL | 0.4 |
| Research Octane Number (RON) | 95 min |
| Motor Octane Number (MON) | 85 min |
| (RON + MON)/2 | 90 min |

The test procedure used in this series of tests was the Mercedes-Benz M 102 E Inlet Valve Cleanliness Test. This is an engine dynamometer test which utilizes a Mercedes-Benz 102 2.3 liter engine with Bosch KE-Jetronic fuel injection. The engine is operated for 60 hours under cycling conditions, with the intake valves pegged to prevent rotation. The test cycle is broken into four operating segments, with a total cycle time of 4.5 minutes. The four stages are shown in Table VI.

TABLE VI

| STAGE | TIME, min | SPEED, rpm | TORQUE, Nm | POWER, Kw |
|---|---|---|---|---|
| 1 | 0.5 | 800 | 0 | 0 |
| 2 | 1.0 | 1300 | 29.4 | 4 |
| 3 | 2.0 | 1850 | 32.5 | 6.3 |
| 4 | 1.0 | 3000 | 35.0 | 11.0 |

Before beginning a test, intake ports and combustion chambers are cleaned of any deposits. Spark plugs are checked and replaced if necessary, and fuel injectors are checked for proper fuel delivery. Cleaned, pre-weighed intake valves are installed in the head using new valve stem seals. Intake valve guides are monitored for wear and replaced when necessary. The engine is charged with 3.7 kg of CEC-RL 140 Reference Oil. When the test is in its last hour of operation, blow-by is measured at the conditions of Stage 4. Blow-by cannot exceed 20 liters per minute.

Once the test has concluded, the intake valves are removed from the engine. Deposits on the combustion chamber side of the valves are cleaned, the intake valve is submerged in n-heptane for 10 seconds, and then shaken dry. After 10 minutes of drying, the intake valves are weighed, and the weight increase due to deposits is recorded. In these tests, a visual rating of the valves was performed using the CRC Valve Rating Scale.

Table VII summarizes the results of this series of tests. Fuel I is the above base fuel. Fuel J is the above base fuel containing 255 ptb of the succinimide based detergent/dispersant composition (HiTEC® 4450 additive; Ethyl Petroleum Additives, Inc.). Fuel K is a fuel of this invention in that it contains both the foregoing succinimide based detergent/dispersant (250 ptb) and 6.4 ppm of manganese as methylcyclopentadienyl manganese tricarbonyl. Fuels J and K both contained paraffinic mineral oil carrier fluid and active succinimide detergent in a weight ratio of approximately 3.3: 1, respectively.

TABLE VII

| | INTAKE VALVE DEPOSIT WEIGHT, mg | | | | | CRC |
|---|---|---|---|---|---|---|
| FUEL | VALVE 1 | VALVE 2 | VALVE 3 | VALVE 4 | VALVE AVERAGE | VALVE RATING |
| I | 272 | 341 | 565 | 309 | 372 | 7.5 |
| J | 6 | 108 | 14 | 114 | 61 | 8.8 |
| K | 10 | 31 | 11 | 46 | 24 | 9.4 |

In a paper entitled "Particulate Emissions from Current Model Vehicles Using Gasoline with Methylcyclopentadienyl Manganese Tri-carbonyl" by R. H. Hammerle, T. J. Korniski, J. E. Weir, E. Chladek, C. A. Gierczak and R. G. Hurley of the Ford Motor Company (SAE Technical Paper No. 912436), and in a paper entitled "The Effect on Emissions and Emission Component Durability by the Fuel Additive Methylcyclopentadienyl Manganese Tricarbonyl" (MMT) by R. G. Hurley, L. A. Hansen, D. L. Guttridge, H. S. Gandhi, R. H. Hammerle and A. D. Matzo of the Ford Motor Company (SAE Technical Paper No. 912437), references are made to tests conducted using an unleaded gasoline containing MMT and Chevron's patented Techroline gasoline additive in the concentration used in their commercial gasolines. This Chevron additive (available commercially as Chevron OGA-480 additive) is a carbamate detergent/dispersant-based composition containing polyether and amine groups joined by a carbamate linkage.

Inasmuch as this test fuel used by Ford is deemed to be the closest composition not of this invention to the gasoline compositions of this invention, tests were conducted to compare the effectiveness of this Ford combination of detergent/dispersant and a cyclopentadienyl complex of a transition metal with the effectiveness of two different fuel compositions of this invention. In a series of such tests, comparative performance was determined using a Ford 2.3 Liter Intake Valve Deposit Test.

This 2.3 Liter Ford Test uses a 1985 2.3 Liter Ford engine cycled between high idle and moderate load conditions. The operating conditions are shown in Table VIII. The total time for each 2-stage cycle is 4 minutes. During the test, the engine coolant-out temperature is controlled to 165°±5° F. A typical mid continent regular unleaded gasoline was used as the base fuel.

TABLE VIII

| EVENT | DURATION | RPM | HP |
|---|---|---|---|
| Power | 3 min. | 2800 | 36–38 |
| Idle | 1 min. | 2000 | 0–4 |

The test engine is assembled to manufacturer's specifications. Each test begins with new, pre-weighed intake valves. New exhaust valves are installed every fourth test. Valve seals are replaced each test. Fuel and air delivery systems are cleaned and rated. Spark plugs are replaced, injectors are checked for the proper fuel flow rate, and the engine is charged with fresh 10W-40 oil.

After 112 hours of cycling, the intake valves are removed from the engine. Deposits are removed from the intake valve face and seal ridge. The valves are rinsed with hexane, dried in a 200° F. oven, and stored in a desiccator until they are weighed and rated.

These tests were conducted consecutively under the above test conditions in the same Ford 2.3 liter engine with the same cylinder head and with the same batch of base fuel (Union Oil Company clear— i.e., additive-free—gasoline). Table IX summarizes the additive compositions and the test results in these 2.3 Liter Ford Intake Valve Deposit Tests. In Table IX, additive A is a long-chain Mannich base intake valve deposit control composition in which the Mannich base dispersant was Amoco 597 additive. The composition was composed of equal parts by weight of Amoco 597 additive and a 600 neutral paraffinic oil carrier fluid. Small, conventional amounts of other conventional additives (rust inhibitor, demulsifying agent, etc.) were present in Additive A. Additive B was the commercially available carbamate-based detergent/dispersant composition (Chevron OGA-480 additive). Additive C was a succinimide-based detergent/dispersant composition (HiTEC®4403 additive; Ethyl Petroleum Additives, Inc.). The fuels treated with Additive C contained approximately two parts by weight of a mineral oil carrier fluid per part by weight of the active succinimide detergent/dispersant.

Table IX summarizes the results of these comparative tests.

TABLE IX

| TEST NUMBER | ADDITIVE | CONCENTRATION, Pounds Per Thousand Barrels | MMT, 1/32 g Mn Per Gallon | INTAKE VALVE DEPOSIT WEIGHT, mg Valve 1 | Valve 2 | Value 3 | Valve 4 | Valve Average |
|---|---|---|---|---|---|---|---|---|
| 157 | A | 216 | No | 74 | 89 | 58 | 119 | 85 |
| 158 | A | 216 | Yes | 47 | 42 | 39 | 48 | 44 |
| 159 | B | 100 | No | 119 | 138 | 135 | 62 | 114 |
| 160 | B | 100 | Yes | 83 | 110 | 100 | 73 | 92 |
| 161 | C | 150 | Yes | 49 | 66 | 48 | 15 | 44 |
| 162 | C | 150 | No | 82 | 111 | 133 | 45 | 93 |

It will be seen from the data in Table IX that the addition of MMT to the succinimide and Mannich base additive compositions pursuant to this invention resulted in reductions in total intake valve deposits of 53% and 48%, respectively. On the other hand, the reduction was only 19% when the MMT was added to the polyether polyamine carbamate deposit control additive composition.

In other Ford 2.3 Liter Intake Valve Deposit Tests conducted in the same manner as above and using the same base fuel, the results summarized in Table X were obtained. In Table X Fuel L was the additive-free Mid-Continent base fuel. Fuel M was the same base fuel containing 1/32 gram of manganese per gallon as methylcyclopentadienyl manganese tricarbonyl. Fuel N was the same base fuel containing HiTEC® 4403 additive at a concentration of 200 ptb. Fuel O was the same base fuel but which contained 1/32 gram of manganese per gallon as methylcyclopentadienyl manganese tricarbonyl, and HiTEC® 4403 additive at a concentration of 200 ptb. Fuels N and O contained approximately two parts by weight of a mineral oil carrier fluid per part by weight of the active succinimide detergent/dispersant.

TABLE X

| FUEL | INTAKE VALVE DEPOSIT WEIGHT, mg VALVE 1 | VALVE 2 | VALVE 3 | VALVE 4 | VALVE AVERAGE | CRC VALVE RATING |
|---|---|---|---|---|---|---|
| L | 424 | 182 | 429 | 526 | 390 | 8.3 |
| M | 89 | 174 | 316 | 184 | 191 | 8.8 |
| N | 111 | 93 | 31 | 7 | 61 | 9.2 |
| O | 5 | 36 | 8 | 6 | 13 | 9.7 |

In the foregoing Ford 2.3 Liter Tests, it was found that use of the additive combinations of this invention caused significant reductions in the weight of combustion chamber deposits formed during the tests as compared to the tests wherein the methycyclopentadienyl manganese tricarbonyl was not used with the detergent/dispersant composition.

Octane requirements were determined at the beginning, middle and end of each Ford 2.3 Liter Test. In each case, the octane requirement increases were lower for the fuels containing the additive combinations of this invention as compared to the octane requirement increases which occurred with the fuels containing only the detergent/dispersant composition.

As noted above, this invention provides in one of its embodiments a fuel additive concentrate comprising the above-specified fuel-soluble detergent/dispersant, a fuel-soluble cyclopentadienyl manganese tricarbonyl compound, and a fuel-soluble liquid carrier or induction aid. Liquid hydrocarbonaceous fuels containing such additive components constitute another embodiment of this invention. In this connection, the term "hydrocarbonaceous fuel" designates not only a blend or mixture of hydrocarbons commonly referred to as gasoline or diesel fuel, but additionally so-called oxygenated fuels (i.e., fuels with which have been blended ethers, alcohols and/or other oxygen-containing fuel blending components as are used in reformulated gasolines and the like). Fuels containing MTBE (methyl tertiary-butyl ether) are preferred oxygenated fuels, Another embodiment of this invention is a method of controlling intake valve deposits in internal combustion engines operated on gasoline, which method comprises producing and/or providing and/or using as the fuel therefor, a fuel composition as described in the immediately preceding paragraph.

The following Examples in which all parts are by weight illustrate, but are not intended to limit, this invention.

EXAMPLE 1

A fuel additive concentrate is prepared from the following ingredients:

A) 50 parts of a detergent/dispersant formed by reacting polyisobutenylsuccinic anhydride having an acid number of 1.1 (made by reaction of maleic anhydride and polyisobutene having number average molecular weight of 950) with a commercial mixture approximating triethylene tetramine, in a mole ratio 2:1 respectively.

B1) 75 parts of naphthenic mineral oil of Witco Corporation H-4053.

B2) 25 parts of 10 cSt unhydrotreated PAO formed by oligomerization of 1-decene.

C) 11.6 parts of methylcyclopentadienyl manganese tricarbonyl

D) 3.5 parts of a demulsifier mixture composed of alkylaryl sulfonates, polyoxyalkylene glycols and oxyalkylated alkylphenolic resins in alkylbenzenes (TOLAD® 9308).

E) 2 parts percent of tetrapropenyl succinic acid supplied as a 50% solution in light mineral oil.

This concentrate is blended with gasolines and with diesel fuels at concentrations of 155 pounds per thousand barrels (ptb).

EXAMPLE 2

A fuel additive concentrate is prepared using components A), B1), B2) and C) as described in Example 1 in the following proportions: 60 parts of A); 60–80 parts of B1); 40–60 parts of B2); and 14 parts of C). In addition, 4 parts of a tertiary butylated phenol antioxidant mixture containing a minimum of 75 percent of 2,6-di-tert-butylphenol, 10–15 percent of 2,4,6-tri-tert-butyl-phenol, and 15–10 percent of 2-tert-butylphenol; 3 parts of Tolad® 286; and 2 parts of tetrapropenyl succinic acid supplied as a 50% solution in light mineral oil are included in the product. This mixture is then blended with gasoline at a rate of 180 pounds per thousand barrels (ptb).

EXAMPLE 3

A fuel additive concentrate is prepared using components A), B1), B2) and C) as described in Example 1 in the following proportions: 75 parts of A); 75–100 parts of B1); 75 parts of B2) and 17.5 parts of C) are used. In addition, 5 parts of a tertiary butylated phenol antioxidant mixture containing a minimum of 75 percent of 2,6-di-tert-butylphenol, 10–15 percent of 2,4,6-tri-tert-butyl-phenol, and 15–10 percent of 2-tert-butylphenol; 3.5 parts of Tolad®9308; and 2 parts of tetrapropenyl succinic acid supplied as a 50% solution in light mineral oil are included in the finished concentrate. This product mixture is then blended with gasoline at a rate of 225–250 pounds per thousand barrels (ptb).

EXAMPLE 4

A fuel additive concentrate is prepared from the following ingredients:

A) 30 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 1.8:1 respectively.

B) 60 parts of naphthenic mineral oil (Exxon 900 solvent neutral pale oil).

C) 7 parts of methylcyclopentadienyl manganese tricarbonyl.

D) 2.8 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol (ETHYL® antioxidant 733, Ethyl Corporation).

E) 1.5 parts of a demulsifier mixture composed of alkylaryl sulfonates, polyoxyalkylene glycols and oxyalkylated alkylphenolic resins in alkylbenzenes (TOLAD® 286).

F) 6 parts of an aromatic solvent with a boiling range of 196°–256° C. and a viscosity of 1.7 cSt at 25° C.

G) 0.5 part of tetrapropenyl succinic acid, supplied as a 50% solution in light mineral oil.

This concentrate is blended with gasoline at a concentration of 150 pounds per thousand barrels (ptb).

EXAMPLE 5

Example 4 is repeated using each of the components set forth therein except that 180 ptb of the additive concentrate is formulated with gasoline.

EXAMPLE 6

Example 4 is repeated using each of the components set forth therein except that 225 ptb of the additive concentrate is used in the gasoline mixture.

EXAMPLE 7

A fuel additive concentrate is prepared from the following ingredients:

A) 60 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 2:1 respectively.

B) 140 parts of polyoxyalkylene compound having an average molecular weight in the range of from about 1500 to about 2000.

C) 14 parts of methylcyclopentadienyl manganese tricarbonyl.

D) 2 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol.

E) 3.4 parts of a demulsifier mixture composed of polyoxyalkylene glycols and oxyalkylated alkylphenolic resins in alkylbenzenes (TOLAD® 9308).

F) 48 parts of Aromatic 150 solvent.

This concentrate is blended with gasolines and with diesel fuels at concentrations of 250 pounds per thousand barrels.

EXAMPLE 8

A fuel additive concentrate is prepared from the following ingredients:

A) 135 parts of a detergent/dispersant formed by reacting polyisobutenylsuccinic anhydride having an acid number of 1.1. (made by reaction of maleic anhydride and polyisobutene having a number average molecular weight of 950) with a commercial mixture approximating triethylene tetramine, in a mole ratio of 2:1 respectively.

B1) 135 parts of naphthenic mineral oil of Witco Corporation 4053-Heavy.

B2) 67.5 parts of 10 cSt hydrotreated PAO formed by oligomerization of 1-decene, and catalytic hydrogenation of the oligomer.

B3) 67.5 parts of polyoxyalkylene compound (Polyglycol 1200; Chemical Co.)

C) 31.5 parts of methylcyclopentadienyl manganese tricarbonyl.

D) 30 parts of a mixture of 15 parts of N,N'-di-sec-butyl-p-phenylenediamine and 15 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol.

E) 10 parts of a demulsifier mixture composed of alkylaryl sulfonates, polyoxyalkylene glycols and oxyalkylated alkylphenolic resins in alkylbenzenes (TOLAD® 286K).

F) 120 parts of an aromatic solvent with a boiling range of 196°–256° C. and a viscosity of 1.7 cSt at 25° C.

G) 5 parts of aspartic acid, N-(3-carboxy-1-oxo-2-propenyl)-N-octadecyl-bis(2-methylpropyl) ester.

This concentrate is blended with gasolines and with diesel fuels at concentrations of 400, 800, 1200 and 2000 ppm.

EXAMPLE 9

Example 8 is repeated except that component G) is omitted.

EXAMPLE 10

Example 8 is repeated using each of the components set forth therein except that 150 parts of component A) and 105 parts of component F) are used.

EXAMPLE 11

Example 8 is repeated using as component A) 135 parts of a detergent/dispersant formed .by reacting polyisobutenylsuccinic anhydride (made by reaction of maleic anhydride and polyisobutene having a number average molecular weight of 750) and an acid number of 1.2 with triethylene tetramine in a mole ratio of 1.8: 1 respectively.

EXAMPLE 12

Example 8 is repeated using as component A) 135 parts of a detergent/dispersant formed by reacting polyisobutenylsuccinic anhydride with an acid number of 1.0 (made by reaction of maleic anhydride and polyisobutene having a number average molecular weight of 1200) with triethylene tetramine in a mole ratio of 2.2:1 respectively.

EXAMPLE 13

Example 8 is repeated with the following changes: Component A) is 170 parts of the detergent/dispersant admixed with 520 parts of 500 Solvent Neutral Oil, the acid number of the polyisobutenylsuccinic anhydride used in making the detergent dispersant is 0.9, and 65 parts of component F) are used.

EXAMPLE 14

Examples 1–13 are repeated except that component C) is ethylcyclopentadienyl manganese tricarbonyl.

EXAMPLE 15

Examples 1–13 are repeated except that component C) is indenyl manganese tricarbonyl (used on an equal weight of manganese basis).

EXAMPLE 16

Examples 1–3 are repeated substituting an equal amount of 10 cSt hydrotreated PAO oligomer (ETHYLFLO 170 oligomer; Ethyl Corporation) as component B2) thereof.

EXAMPLE 17

Examples 8–13 are repeated except that component B2) is 67.5 parts of 10 cSt unhydrogenated PAO produced from 1-decene.

As can be seen from the above examples, it is preferable to include in the fuel compositions and fuel additive concentrates of this invention other types of additives such as antioxidants, demulsifiers, corrosion inhibitors, aromatic solvents, diluent oils, etc.

Antioxidant

Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominately or entirely of either (1) a hindered phenol antioxidant such as 2,6-di-tert-butylphenol, 4-methyl-2,6-di-tert-butylphenol, 2,4-di-methyl-6-tert-butylphenol, 4,4'-methylenebis(2,6-di- tert-butyl phenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are combinations of tertiary butyl phenols, such as 2,6-di-tert-butylphenol, 2,4,6-tri-tert-butylphenol and o-tert-butylphenol, such as ETHYL® antioxidant 733, or ETHYL® antioxidant 738. Also useful are N,N'-di-lower-alkyl phenylenediamines, such as N,N'-di-sec-butyl-p-phenylenediamine, and its analogs, as well as combinations of such phenylenediamines and such tertiary butyl phenols.

Demulsifier

A wide variety of demulsifiers are available for use in the practice of this invention, including, for example, organic sulfonates, polyoxyalkylene glycols, oxyalkylated phenolic resins, and like materials. Particularly preferred are mixtures of alkylaryl sulfonates, polyoxyalkylene glycols and oxyalkylated alkylphenolic resins, such as are available commercially from Petrolite Corporation under the TOLAD trademark. One such proprietary product, identified as TOLAD 286K, is understood to be a mixture of these components dissolved in a solvent composed of alkyl benzenes. This product has been found efficacious for use in the compositions of this invention. A related product, TOLAD 286, is also suitable. In this case the product apparently contains the same kind of active ingredients dissolved in a solvent composed of heavy aromatic naphtha and isopropanol. However, other known demulsifiers can be used.

Diluent Oil

This component of the compositions of this invention can be widely varied inasmuch as it serves the purpose of maintaining compatibility and keeping the product mixture in the liquid state of aggregation at most temperatures commonly encountered during actual service conditions. Thus use may be made of such materials as hydrocarbons, alcohols, and esters of suitable viscosity and which ensure the mutual compatibility of the other components. Preferably the diluent is a hydrocarbon, more preferably an aromatic hydrocarbon. For best results the diluent oil is most preferably an aromatic solvent with a boiling range in the region of 190°–260° C. and a viscosity of 1.5 to 1.9 cSt at 25° C.

Corrosion Inhibitor

Here again, a variety of materials are available for use as corrosion inhibitors in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the aminosuccinic acids or derivatives thereof represented by the formula:

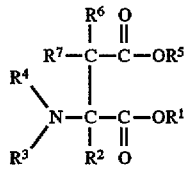

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

The relative proportions of the various supplemental ingredients used in the additive concentrates and distillate fuels of this invention can be varied within reasonable limits. However, for best results, these compositions should contain from 5 to 35 parts by weight (preferably, from 15 to 25 parts by weight) of antioxidant, from 2 to 20 parts by weight (preferably, from 3 to 12 parts by weight) of demulsifier, and from 1 to 10 parts by weight (preferably, from 2 to 5 parts by weight) of corrosion inhibitor per each one hundred parts by weight of detergent/dispersant present in the composition. The amount of diluent oil (compatibilizing oil) can be varied within considerable limits, e.g., from 5 to 150 parts by weight per hundred parts by weight of the detergent/dispersant. As noted above, the detergent/dispersant can be made in the presence of an ancillary diluent or solvent or such may be added to the detergent/dispersant after it has been produced so as to improve its handle ability. Thus, the concentrates and fuels may also contain from 0 to 400, preferably 100 to 300 parts, of ancillary solvent oil per 100 parts by weight of the detergent/dispersant.

The above additive compositions of this invention are preferably employed in gasolines, but are also suitable for use in middle distillate fuels, notably, diesel fuels and fuels for gas turbine engines. The nature of such fuels is so well known to those skilled in the art (and even to many persons unskilled in the art) as to require no further comment. It will of course be understood that the base fuels may contain other commonly used ingredients such as cold starting aids, dyes, metal deactivators, cetane improvers, emission control additives, and the like. Moreover the base fuels may contain oxygenates, such as methanol, ethanol, and/or other alcohols, methyl tert-butyl ether, methyl tert-amyl ether and/or other ethers, and other suitable oxygen-containing substances.

Fuel-soluble acyclic hydrocarbyl-substituted polyamines and procedures by which they can be prepared are described for example in U.S. Pat. Nos. 3,438,757; 3,454,555; 3,574,576; 3,671,511; 3,746,520; 3,844,958; 3,852,258; 3,864,098; 3,876,704; 3,884,647; 3,898,056; 3,931,024; 3,950,426; 3,960,515; 4,022,589; 4,039,300; 4,168,242; 4,832,702; 4,877,416; 5,028,666; 5,034,471; in PCT applications WO 86/05501 published 25 Sep. 1986; WO 88/03931 published 2 Jun. 1988; and WO 90/10051 published 7 Sep. 1990.; in EP Patent No.244,616 B1; and in EPO Publication Nos. 382,405; 384,086; and 389,722. The complete disclosures of each of the foregoing documents are incorporated herein by reference. The preferred components of this type are the fuel-soluble polyisobutenyl polyamines derived from aliphatic polyamines such as ethylene diamine, diethylene triamine, hexamethylene diamine, triethylene tetramine, N-(2-aminoethyl)ethanolamine, and the like.

A typical formulated polyisobutenyl polyamine is Lubrizol® 8195 additive. According to the manufacturer, this product has a nitrogen content of 0.31 wt %, a TBN of 12.2, a specific gravity at 15.6° C. of 0.882, a viscosity at 40° C. of 35.2 cSt, a viscosity at 100° C. of 7.4 cSt, and a PMCC flash point of 41° C., and yields no sulfated ash.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

What is claimed is:

1. A fuel additive composition comprising:

i) at least one fuel-soluble acyclic hydrocarbyl-substituted polyamine;

ii) at least one fuel-soluble cyclopentadienyl manganese tricarbonyl compound; and iii) at least one fuel-soluble liquid carrier fluid;

wherein i) and iii) together comprise a polyisobutenyl polyamine formulation having a nitrogen content of 0.31 wt %. a TBN of 12.2. a specific gravity at 15.6° C. of 0.882, a viscosity at 40° C. of 35.2 cSt, a viscosity at 100° C. of 7.4 cSt, and a PMCC flash point of 41° C. and yields no sulfated ash: i), ii) and iii) being in amounts effective to reduce the weight of intake valve deposits in a spark-ignition internal combustion engine operated on a gasoline-based fuel containing an intake valve deposit-controlling amount of said fuel additive compound, as compared to the weight of intake valve deposits in said engine operated in the same manner on the same fuel except that it is devoid of cyclopentadienyl manganese tricarbonyl compound.

2. A composition according to claim 1 wherein said cyclopentadienyl manganese tricarbonyl compound is a cyclopentadienyl manganese tricarbonyl compound that exists as a liquid at 25° C.

3. A composition according to claim 1 further comprising a minor but effective amount of:

a) at least one fuel-soluble antioxidant; or b) at least one fuel-soluble demulsifier; or c) at least one fuel-soluble rust or corrosion inhibitor; or d) any combination of any two or all three of a), b) and c) hereof.

4. A composition according to claim 1 further comprising a minor but effective amount of:

a) at least one fuel-soluble antioxidant; and b) at least one fuel-soluble demulsifier; and c) at least one fuel-soluble rust or corrosion inhibitor.

5. A fuel additive composition comprising:

i) at least one fuel-soluble long chain aliphatic polyamine wherein the long chain aliphatic group of said polyamine contains an average of 50 to 350 carbon atoms in the form of alkyl or alkenyl groups;

ii) at least one fuel-soluble cyclopentadienyl manganese tricarbonyl compound; and iii) at least one fuel-soluble liquid carrier fluid;

wherein i) and iii) together comprise a polyisobutenyl polyamine formulation having a nitrogen content of 0.31 wt %. a TBN of 12.2, a specific gravity at 15.6° C. of 0.882. a viscosity at 40° C. of 35.2 cSt, a viscosity at 100° C. of 7.4 cSt, and a PMCC flash point of 41° C., and yields no sulfated ash: i), ii) and iii) being in amounts effective to reduce the weight of intake valve deposits in a spark-ignition internal combustion engine operated on a gasoline-based fuel containing an intake valve deposit-controlling amount of said fuel additive compound, as compared to the weight of intake valve deposits in said engine operated in the same manner on the same fuel except that it is devoid of cyclopentadienyl manganese tricarbonyl compound.

6. A composition according to claim 5 wherein said cyclopentadienyl manganese tricarbonyl compound is a cyclopentadienyl manganese tricarbonyl compound that exists as a liquid at 25° C.

7. A composition according to claim 5 wherein said composition comprises from about 5 to about 50 weight percent of said polyamine and about 1 to about 15 weight percent of said cyclopentadienyl manganese tricarbonyl compound.

8. A composition according to claim 5 wherein said composition comprises from about 10 to about 25 weight percent of said polyamine and about 3 to about 10 weight percent of said cyclopentadienyl manganese tricarbonyl compound.

9. A composition according to claim 5 wherein the weight ratio of said polyamine to manganese in the form of said cyclopentadienyl manganese tricarbonyl compound is within the range of about 3:1 to about 100:1.

10. A composition according to claim 5 wherein the weight ratio of said polyamine to manganese in the form of said cyclopentadienyl manganese tricarbonyl compound is within the range of about 6:1 to about 50:1.

11. A composition according to claim 5 further comprising a total of up to about 10 weight percent based on the total weight of said composition, of one or more additives selected from fuel-soluble antioxidants, demulsifying agents, rust or corrosion inhibitors, metal deactivators, and marker dyes.

12. A fuel composition for internal combustion engines, said fuel composition comprising a gasoline-based fuel and an intake valve deposit controlling amount of a combination of (i) at least one fuel-soluble acyclic hydrocarbyl-substituted polyamine;

(ii) at least one fuel-soluble cyclopentadienyl manganese tricarbonyl compound; and (iii) at least one fuel-soluble liquid carrier fluid, wherein i) and iii) together comprise a polyisobutenyl polyamine formulation having a nitrogen content of 0.31 wt %. a TBN of 12.2, a specific gravity at 15.6° C. of 0.882, a viscosity. at 40° C. of 35.2 cSt, a viscosity at 100° C. of 7.4 cSt, and a PMCC flash point of 41 ° C. and yields no sulfated ash: and wherein said intake valve deposit controlling amount of said combination is effective to reduce the weight of intake valve deposits in a spark-ignition internal combustion engine operated on said fuel composition, as compared to the weight of intake valve deposits in said engine operated in the same manner on the same fuel composition except that it is devoid of cyclopentadienyl manganese tricarbonyl compound.

13. A composition according to claim 12 wherein said cyclopentadienyl manganese tricarbonyl compound is a cyclopentadienyl manganese tricarbonyl compound that exists as a liquid at 25° C., and wherein said composition further comprises a minor but effective amount of:

a) at least one fuel-soluble antioxidant; or b) at least one fuel-soluble demulsifier; or c) at least one fuel-soluble rust or corrosion inhibitor; or d) any combination of any two or all three of a), b) and c) hereof.

14. A composition according to claim 12 wherein the amount of said cyclopentadienyl manganese tricarbonyl compound is up to about 1/32 gram of manganese per gallon of said fuel.

15. A composition according to claim 12 wherein said cyclopentadienyl manganese tricarbonyl compound is methylcyclopentadienyl manganese tricarbonyl, and wherein the amount of said methylcyclopentadienyl manganese tricarbonyl is up to about 1/32 gram of manganese per gallon of said fuel.

16. A method of controlling intake valve deposits in internal combustion engines operated on gasoline, which method comprises providing as the fuel therefor, a fuel composition comprising a gasoline-based fuel and an intake valve deposit controlling amount of a combination of (i) at least one fuel-soluble acyclic hydrocarbyl-substituted polyamine;

(ii) at least one fuel soluble cyclopentadienyl manganese tricarbonyl compound; and (iii) at least one fuel-soluble liquid carrier fluid, wherein i) and iii) together comprise a polyisobutenyl polyamine formulation having a nitrogen content of 0.31 wt %. a TBN of 12.2. a specific gravity at 15.6° C. of 0.882. a viscosity at 40° C. of 35.2 cSt, a viscosity at 100° C. of 7.4 cSt, and a PMCC flash point of 41 ° C. and yields no sulfated ash: and wherein said intake valve deposit controlling amount of said combination is effective to reduce the weight of intake valve deposits in a spark-ignition internal combustion engine operated on said fuel composition, as compared to the weight of intake valve deposits in said engine operated in the same manner on the same fuel composition except that it is devoid of cyclopentadienyl manganese tricarbonyl compound.

17. A method according to claim 16 wherein said cyclopentadienyl manganese tricarbonyl compound is a cyclopentadienyl manganese tricarbonyl compound that exists as a liquid at 25 ° C., and wherein the amount of said cyclopentadienyl manganese tricarbonyl compound is up to about 1/32 gram of manganese per gallon of said fuel.

* * * * *